United States Patent [19]

Cramer

[11] 4,237,712

[45] Dec. 9, 1980

[54] LATCH AND CYLINDER GUARD

[76] Inventor: David J. Cramer, 10472 Dupont Rd., Bloomington, Minn. 55431

[21] Appl. No.: 953,095

[22] Filed: Oct. 20, 1978

[51] Int. Cl.[3] ..... E05B 63/00

[52] U.S. Cl. ..... 70/417; 70/452

[58] Field of Search ..... 70/417, 416, 452; 292/346; 49/504

[56] References Cited

U.S. PATENT DOCUMENTS

| | | | |
|---|---|---|---|
| 3,645,045 | 2/1972 | Gervis | 49/504 |
| 3,768,284 | 10/1973 | Kent | 70/104 |
| 4,074,552 | 2/1978 | Smith | 70/417 |

*Primary Examiner*—Robert L. Wolfe

*Attorney, Agent, or Firm*—Donald A. Jacobson

[57] ABSTRACT

A latch and cylinder guard which can be bolted through a door without interfering with the latch and providing a double layer of metal in the latch vicinity.

4 Claims, 3 Drawing Figures

LATCH AND CYLINDER GUARD

BACKGROUND OF THE INVENTION

I. Field of the Invention

The present invention relates to a protective cover for a latch and lock cylinder to prevent removal of the lock cylinder or forcing of the door latch.

II. Description of the Prior Art

A typical door lock can be opened without a key in a number of ways by a knowledgeable person, for example, the cylinder of the lock can be removed to permit the lock mechanism to be operated directly; a sheet of flexible plastic can be inserted between the door jamb and bolt to force the bolt open; the door can be sprung, in the vicinity of the lock, in order to release the bolt; and the locking mechanism can be battered or removed. In order to combat this unauthorized entry, there are a number of protective devices available for locks and doors. One such device is disclosed in Mora, U.S. Pat. No. 2,114,075; wherein a rigid metal plate is bolted over a door lock having an opening therethrough for a key and a projection perpendicular to the door face adjacent the edge to engage a U-shaped projection on a second plate attached to the door jamb. This device protects aganist the removal of the cylinder and forcing the bolt with a plastic sheet. The disadvantage of this device are its relatively complex structure and difficulty of installation.

Another prior art disclosed in Jervis, U.S. Pat. No. 3,645,045 consists of two members: the first, a lock guard consists of a heavy plate with a recess to cover the end of the lock cylinder, and a raised edge to match the second member. An elongated hole opposite the lock cylinder is of such a size that a key can be inserted to operate the lock, but the lock cylinder cannot be removed. This plate is large enough to be bolted to the door over the lock regardless of the orientation of the lock. The second member consists of an elongated plate with a perpendicular projection. This second member is bolted to the door adjacent to the edge to protect the lock and the bolt. The disadvantages of this device are its relatively complex structure, its large size and installation difficulty.

No prior art device known to me provides the combination of attributes of the present invention, namely, a simple cylinder and lock guard providing a double layer of metal in the vicinity of the lock, smaller size, simple installation procedure, and attachment means to avoid the locking mechanism.

SUMMARY OF THE INVENTION

The present invention consist, in part, of a heavy plate, which is secured in place by a mating clip and a bolt. A hole over the lock cylinder permits unlocking the latch with a key while protecting the cylinder against removal. The holding clip and a second matching clip provide a double layer of metal in the vicinity of the door latch for additional protection of the lock. One end of the plate is held by the clip and a foreshortened bolt which penetrates only the outer skin of the door; the opposite end of the plate is secured by a bolt fastened completely through the door and second clip. This unsymmetrical attachment method permits bolting the plate over the latch mechanism without interferring with the mechanism itself.

OBJECTS

It is accordingly the principle object of the present invention to provide a new and improved latch and cylinder guard which is simple in construction and installation.

It is another and more particular object of the present invention to provide a maximum amount of protection in the vicinity of the latch.

It is yet another object of the present invention to provide an attachment means which avoids the locking mechanism.

DETAILED DESCRIPTION OF THE INVENTION

Figure 2:
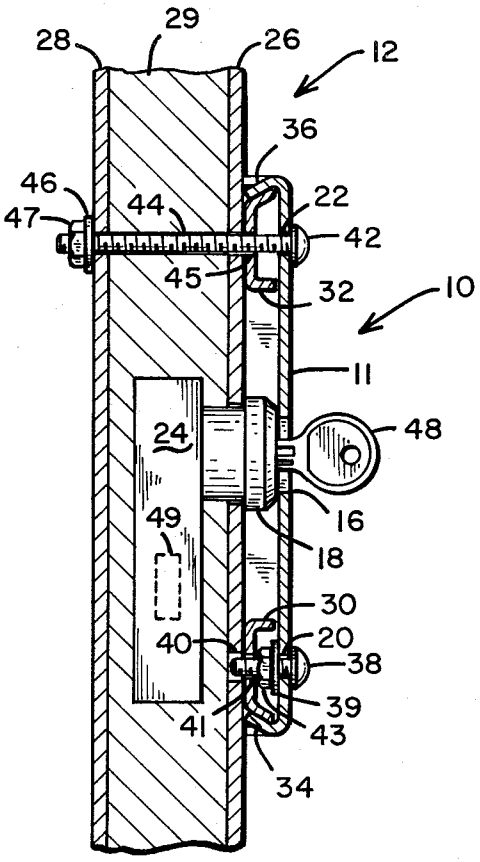
FIG. 2 is a cross-sectional view of the device taken along the line 2—2 of FIG. 1.
Figure 1:
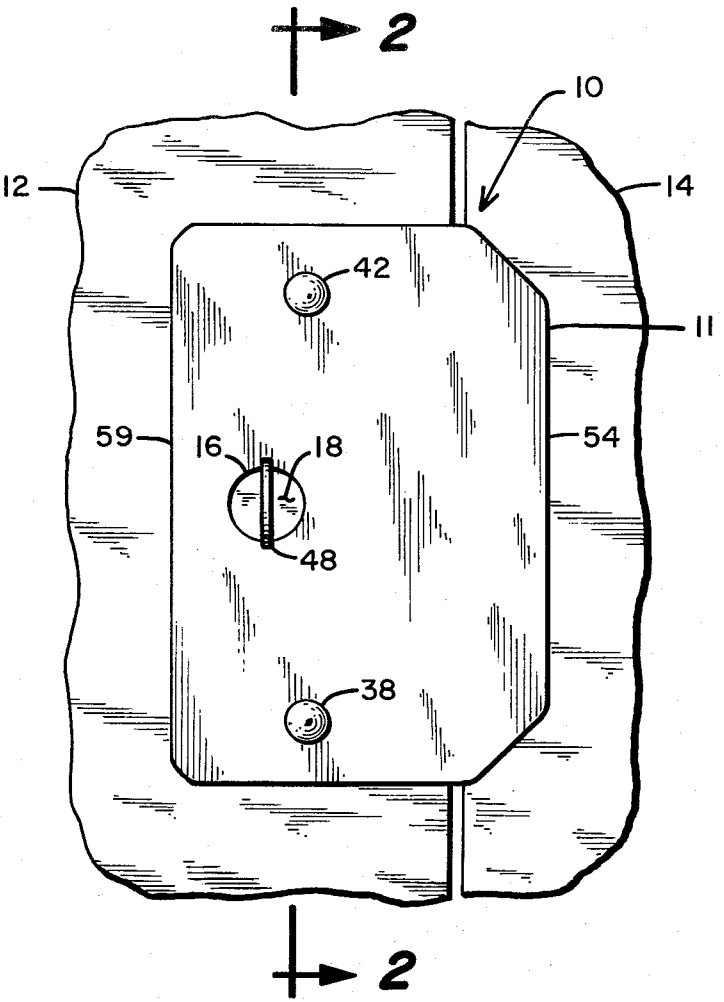
FIG. 1 is a front view of one embodiment of the device attached to a door.
Figure 3:
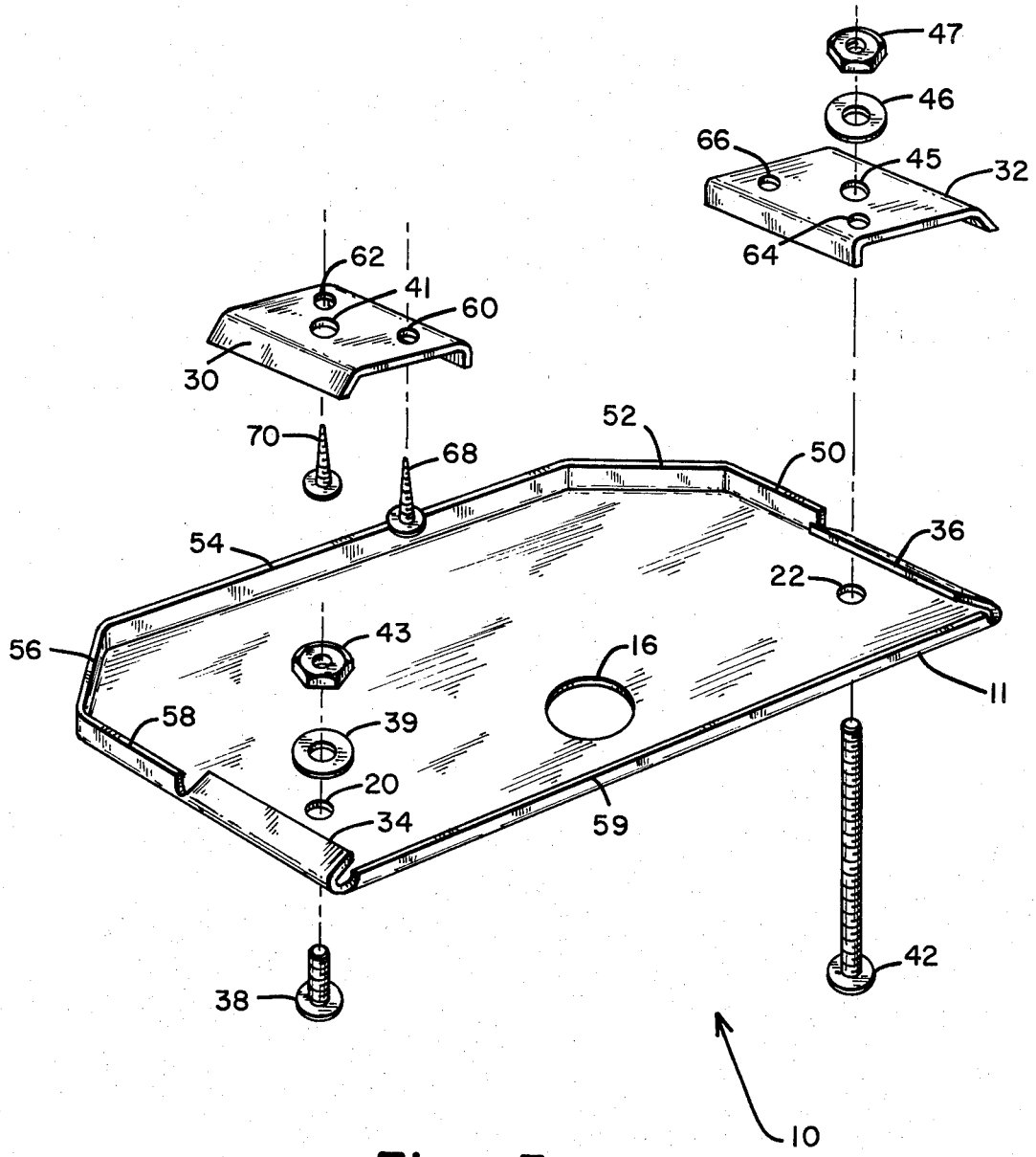
FIG. 3 is an exploded underview of the component parts of the device.

The preferred embodiment of the guard, generally described as 10, is illustrated in FIGS. 1, 2 and 3. Referring to FIG. 1, a plate 11 is attached to a door 12, which is in a closed position adjacent to a door jamb 14. A hole 16 in plate 11 provides access to a lock cylinder 18.

Referring to FIG. 2, holes 20 and 22 in plate 11 provide access for an attachment means. The relationship between a lock 24, door 12 and plate 11 is shown. Door 12 has two metal surfaces 26 and 28 and a core 29. Two clips 30 and 32 each having a perpendicular edge and an opposing obtuse edge, engage lips 34 and 36 respectively of plate 11 which said obtuse edges. A bolt 38 is secured in hole 20 in plate 10 by a washer 39 and a nut 43. Bolt 38 is inserted through a hole 41 in clip 30 into a hole 40 in the skin 26 of door 12 of a suitable size to accept said bolt. Bolt 38 is not threaded into hole 40. Bolt 42 is inserted through hole 22 in plate 11, a hole 45 in clip 32 and a hole 44 which pierces the entire door, and then engages washer 46 and nut 47. A key 48 is shown in place in lock cylinder 18. Latch 49 is operated by lock cylinder 18.

Referring to FIG. 3, the underportion of plate 11, the interaction between clips 30, 32 and plate 11 and the means of attaching said clips to the door can be seen. Edges 50, 52, 54, 56, 58 and 59 of plate 11 are perpendicular to its surface. Perpendicular edges 56 and 52 form an obtuse angle with perpendicular edges 54, 58 and 50, 54 respectively. Edges 34 and 36 form an acute angle with the surface of plate 11. Holes 60 and 62 in clip 30 and holes 64 and 66 in clip 32 are provided for sheet metal screws. Clip 30 is attached to the skin 26 of door 12 by sheet metal screws 68 and 70 through holes 60 and 62 respectively. Holes 64 and 66 in clip 32 are not used but are provided to make clips 30 and 32 identical to simplify manufacture.

To attach plate 11 to a door, said plate is held against a closed door in the relationship illustrated in FIG. 1 with holes 16 opposite said lock cylinder 18. Holes 40 and 44 are marked opposite holes 20 and 22 respectively. Plate 11 is removed from the door and hole 40 is drilled through skin 26 of a size adequate to accept bolt 38 and hole 44 is drilled through door 12 of a size adequate to accept bolt 42. Clip 30 is then held against the door, as illustrated in FIG. 2, with hole 41 aligned with hole 40, and two pilot holes are drilled in skin 26 in alignment with holes 60 and 62 of a size adequate to accommodate sheet metal screws 68 and 70. Clip 30 is then attached to skin 26 using sheet metal screws 68 and 70 through holes 60 and 62 respectively into said pilot holes. Bolt 38 is mounted on plate 11, as illustrated in FIG. 2, using washer 39 and nut 43. Clip 32 is mounted in plate 11, as illustrated in FIG. 2, with bolt 42 inserted through hole 22 in plate 11 and hole 45 in clip 32. Plate 11 is then mounted on door 12 with lip 34 engaging the obtuse lip of clip 30 and bolt 42 through hole 44. Washer 46 and nut 47 are attached to the end of bolt 42 to complete the assembly.

In use, perpendicular edges 50, 52, 54, 56, 58 and 59 increased the rigidity of plate 11 to any attempts to insert a wedge under said plate to pry it from door 12. Edges 52 and 56 form an obtuse angle with respect to edges 50, 54 and 54, 58 respectively which also increase the rigidity of plate 11. Edge 54 extends over door jamb 14 to deny access to latch 49. The obtuse edges of clips 30 and 32 and lips 34 and 36 provide a double thickness of metal above and below latch 24 to render the latch more inaccessable to battering. Clip 30 provides additional holding power of plate 11 to door 12 than would bolt 42 alone. Bolt 38 ends in skin 26 to permit plate 11 to be made smaller in size than would be required if bolt 38 completely penetrated door 12 as does bolt 42. If bolt 38 were extended completely through door 12, then plate 11 would have to be longer to permit the bolt to clear lock 24, further, other hardware items attached to the door, such as latch bars, may also have to be moved. Bolt 38 extending into the outer skin 26 of door 12 only, also prevents the rotation of plate 11 about bolt 42. The external appearance of bolt 38 and 42 are the same and do not reveal the fact that bolt 38 is attached any differently than bolt 42.

If latch 24 were reversed and extended upward from cylinder 18, bolts 38 and 42, their matching holes and other hardware, can also be reversed to accommodate this change.

This latch and cylinder guard protector provides a relatively small size guard which is simple to attach and provides a double metal protection adjacent to the latch and a bolt guard.

Although specific construction of the hereindisclosed guard has been shown and described, it is obvious that those skilled in the art may make various modifications and changes to them without departing from the scope and spirit of the instant invention. It is to be expressly understood that the instant invention is limited only by the appended claims.

What is claimed is:

1. In combination with a building entry door of the type having a lock cylinder with a keyhole therein and a key operated latch mounted in one edge of said door, apparatus for rendering said door less susceptible to forced entry, comprising:

(a) a generally rectangular metal plate having its edges bent out of the plane of said plate and having an aperture formed therethrough at a predetermined location; and (b) means for attaching said plate to said entry door with said edges directed inwardly toward said door and with said aperture generally aligned with said keyhole and a first portion of said plate at least partially overlaying said lock cylinder and a second portion of said plate extending beyond said one edge of said door proximate said latch with opposing corners on said second portion of said plate bent inwardly along a diagonal and truncated to the plane formed by the inward extremes of said bent edges with said bent corners and said bent edges forming a continuous surface.

2. Apparatus as in claim 1 wherein first and second portions of said edges are bent at an acute angle and the remaining portions of said edges are bent at an angle of 90°.

3. Apparatus as in claim 2 and further including:

(a) first and second clip members, each comprising a generally rectangular portion and having a first edge thereof bent at an angle which is a supplement to said acute angle and an opposed end bent at an angle of 90°; and (b) means attaching said first and second clip members to a side surface of said entry door with said first and opposed edges of said clip member abutting said side surface of said entry door; and (c) means securing said generally rectangular metal plate to said first and second clip members with said first and second portions of said edges of said plate contacting said first edges of said first and second clip members.

4. Apparatus as in claim 3 wherein said means securing said generally rectangular metal plate member to said entry door comprises a first bolt passing through said plate, one of said clip members and entry through the thickness dimension of said entry door and a second bolt passing through said plate, the other of said clip members and only partially through said thickness dimension of said entry door.

* * * * *